US005992076A

United States Patent [19]

Magnusson

[11] Patent Number: 5,992,076

[45] Date of Patent: Nov. 30, 1999

[54] LOCKING DEVICE FOR FIREARMS

[76] Inventor: Björn Magnusson, Skolgatan 21 A, S-532 31 Skara, Sweden

[21] Appl. No.: 09/068,632

[22] PCT Filed: Nov. 4, 1996

[86] PCT No.: PCT/SE96/01416

§ 371 Date: Jun. 29, 1998

§ 102(e) Date: Jun. 29, 1998

[87] PCT Pub. No.: WO97/16693

PCT Pub. Date: May 9, 1997

[30] Foreign Application Priority Data

Nov. 2, 1995 [SE] Sweden ..... 9503869

[51] Int. Cl.[6] ..... F41A 17/02; F41A 17/44

[52] U.S. Cl. ..... 42/70.11

[58] Field of Search ..... 42/70.11

[56] References Cited

U.S. PATENT DOCUMENTS

| | | | |
|---|---|---|---|
| 4,532,729 | 8/1985 | Muller . | |
| 5,140,766 | 8/1992 | Brooks | 42/70.11 |
| 5,231,236 | 7/1993 | Del Real et al. | 42/70.11 |
| 5,241,769 | 9/1993 | Muller . | |
| 5,419,069 | 5/1995 | Mumbleau et al. | 42/70.11 |
| 5,465,519 | 11/1995 | Blanck | 42/70.11 |
| 5,467,550 | 11/1995 | Mumbleau | 42/70.11 |
| 5,581,927 | 12/1996 | Meller | 42/70.11 |
| 5,782,029 | 7/1998 | Brooks | 42/70.11 |

FOREIGN PATENT DOCUMENTS 4009372 10/1990 Switzerland .

*Primary Examiner*—Charles T. Jordan
*Assistant Examiner*—Denise J. Buckley
*Attorney, Agent, or Firm*—Dvorak & Orum

[57] ABSTRACT

The device relates to a locking device for firearms with a magazine guide. The locking device is insertable into the empty magazine guide of the firearm, and the locking device has a locking unit adapted to direct or indirect lock the functionally essential parts of the firearm, such as the bolt of the firearm, and to lock said locking device in said inserted position.

10 Claims, 4 Drawing Sheets

LOCKING DEVICE FOR FIREARMS

BACKGROUND OF THE INVENTION

1. Field of the Invention

The present invention relates generally to locking devices for firearms having a magazine guide, and particularly to locking devices for fully or semi-automatic firearms.

In the society of today, various kinds of firearms are used by authorities and companies, such as military authorities, the police, customs, security and surveyance companies, arms dealers as well as by private persons. One problem connected with such widespread use is the risk that the firearms many be stolen or used improperly by unauthorized persons. For preventive purposes the firearms may be locked into safes, be locked to wall-mounted weapon locks or the like when stored. However, these locking systems cannot be used during transportation of the firearms, for example to or from a shooting range, in addition to which such systems are expensive and comparatively voluminous.

Another manner of solving this problem is to separate the main firearm components from one another and to store the various components of the firearm in different places in order to make access to a complete firearm more difficult. However, this is a method that is inconvenient to the user, in addition to which it does not prevent separate arm components from being stolen or disappearing and, together with components from other firearms, being assembled by an unauthorized person into a complete firearm. To store and transport firearm components separately obviously involves disadvantages as such, particularly if it becomes necessary to use the firearm very quickly.

Another Type of locking device for firearms is a trigger guard lock which prevents the trigger from being actuated. These locks are, however, usually easy to remove by impact or either damage to the lock, sometimes together with the trigger guard proper, without the firearm becoming unusable. In addition, this type of locking device suffers from the drawback that important components of the firearm, such as the bolt and the barrel, cannot be locked. (The term bolt is to be interpreted herein in a wide sense, as comprising also other movable components, such as components incorporated in the barrel and/or its prolongation.) If the trigger guard lock cannot be removed, these components thus could be removed in an unauthorized manner from the locked firearm and be used together with other firearms.

A further type of locking device for firearms are cartridge chamber locks which are positioned and locked in the cartridge chamber n the firearm barrel. The person using the cartridge chamber lock must insert his finger into the firearm box in order to lock or unlock the cartridge chamber lock when the bolt of the firearm assumes its retracted position. To do this may cause injuries to the fingers, should the spring-biased bolt come loose in the retracted position and be forced forward by spring action towards the barrel. In addition, cartridge chamber locks suffer from the drawback of being difficult to attach because the interior space of the firearm locks usually is very small. Also this type of locking device suffers from the disadvantage that important components of the firearm, such as the bolt, may be removed from a locked firearm by unauthorized persons and be used together with other firearms. It is also comparatively simple to remove the cartridge chamber lock from the barrel by drilling it away by means of a drill inserted from the outer end of the barrel.

SUMMARY OF THE INVENTION

A first object of the present invention is to provide a locking device for firearms which directly or indirectly locks functionally essential parts of the firearms, such as the bolt, to prevent said components from being removed from the firearm unless damage is exerted to the firearm/or the locking device. Another object of the present invention is to provide a locking device for firearms which directly or indirectly prevents casing movements and/or reload movements in a locked firearm.

A third object of the present invention is to provide a locking device which locks the weapon also during transportation and practice.

A fourth object of the present invention is to provide a firearm locking device that is simple to use.

A fifth object of the present invention is to provide a firearm locking device that is cheap to manufacture.

DETAILED DESCRIPTION OF THE DRAWINGS

Various embodiments of the present invention will be described in the following in more detail with reference to the accompanying drawings, wherein.

DETAILED DESCRIPTION OF THE PREFERRED EMBODIMENT

Figure 4:
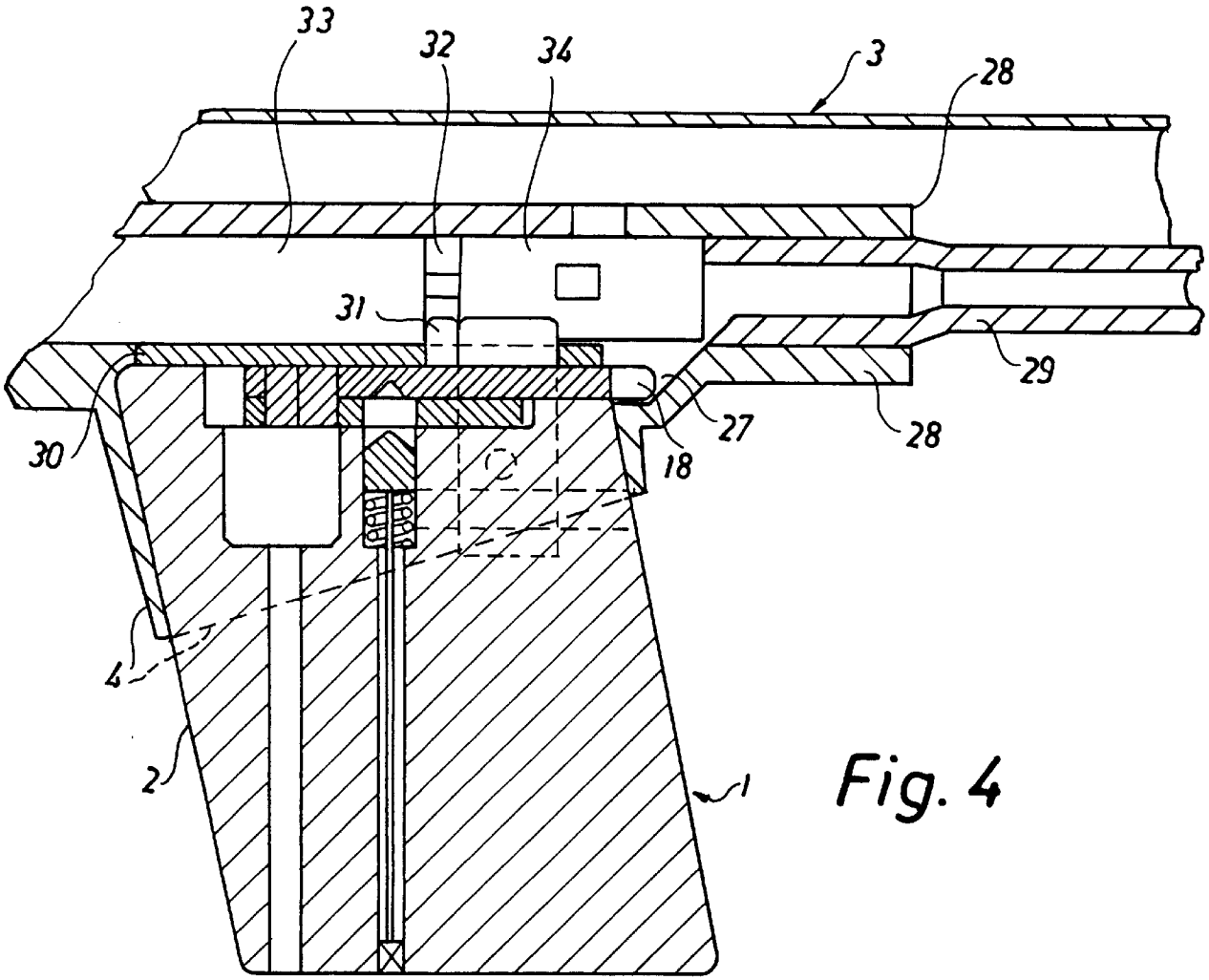
FIG. 4 is a schematical, partly broken sectional view as seen from the side of the locking device in the locked position in a first firearm.

The locking device referred to generally by reference 1 and illustrated in FIGS. 1–4 comprises a body 2 which in a cross-sectional view from above (not shown) essentially is in the shape of a magazine (not shown) and which may be inserted in a magazine guide 4 in the firearm, designated as reference 3, as illustrated in FIG. 4. In this embodiment the firearm 3 is a fully automatic firearm of a type known in Sweden as AK 4.

A locking unit, generally designated by reference 5, is located in the upper part of the locking device 1. The locking unit 5 comprises a locking mechanism 6 which preferably consists of a lock cylinder of standard type. At its lower end, the locking mechanism 6 is associated with a keyhole 7 which extends through the locking device 1 and debouches in the lower part of the locking mechanism 6. In addition, the locking unit 5 comprises an eccentric means generally designated by 8, which is disposed above the locking mechanism. The first and second eccentric means 8 comprises an eccentric disc 9 and a spindle 10 which is connected to the eccentric disc 9 and the locking mechanism 6. In turn, the eccentric disc 9 is positively connected with an aperture 11 formed in a first upper locking jaw 12 and in a second lower locking jaw 13. The first and second locking jaws 12 and 13 are displaceable in parallel in the lengthwise direction of the locking device 1 as seen in FIG. 1, between a locked right-hand position illustrated in FIG. 1 and an unlocked left-hand position (not shown), wherein the rear edges 14,15 of the locking jaws 12 and 13 respectively, are in contact with the rear edge 17 of a recess 16 formed in the body 2.

Figure 1:
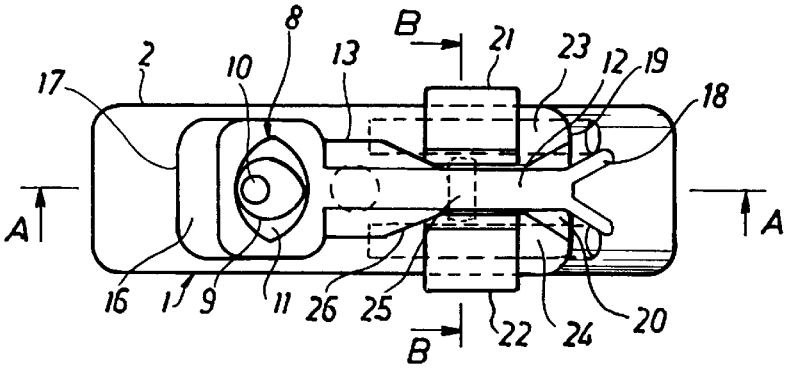
FIG. 1 illustrates a locking device in accordance with the first embodiment as seen schematically from above, with the lid having been removed and with the locking tongue in the locked position.

When a key (not shown) is inserted into the keyhole 7 into engagement with the locking mechanism 6 a rotational movement of the key may cause the first and second locking jaws 12 and 13 to move in the lengthwise direction of the locking device 1 as seen in FIG. 1 via the locking mechanism 6 and the eccentric means 8. Thus, the first and second locking jaws 12 and 13 may be moved between the unlocked position (not shown) in which the fork-shaped end 18 of the first locking jaw 12 is disposed interiorly of the outer edge 19 of the body 2 in a recess 20, in which position the rear edges 14, 15 come into contact with the rear edge 17, and the locked position illustrated in FIG. 1. When the first and second locking jaws 12 and 13 are displaced to the locked position the fork-shaped end 18 of the first locking jaw 12 is made to protrude beyond the edge 19 of the body 2.

The locking device 1 further comprises a third locking jaw 21 and a fourth locking jaw 22 of essentially identical configuration and disposed in the upper part of the locking device 1. The third locking jaw 21 and the fourth locking jaw 22 are movable in the transverse direction of the locking device 1 about spindles 23 and 24 respectively, between the position illustrated in FIG. 3 in dash-and-dot lines and the locked position illustrated in drawing FIG. 3 in continuous lines. The third locking jaw 21 and fourth locking jaw 22 are interconnected by a tension spring 25 situated above the spindles 23, 24, said spring biasing the third and fourth locking jaws 21 and 22 to the unlocked position.

The second locking jaw 13 is at its right-hand end part 26 formed with a plough-shaped end portion 26 as illustrated in FIG. 1. In the unlocked position, when the rear edge engages the rear edge 17, this end portion 26 is disengaged from the third and fourth locking jaws 21 and 22 respectively, the siring bias forcing said locking jaws 21, 22 to assume tee position illustrated in FIG. 3 in a dashed line. When the first and second locking jaws 12, 13 are moved as a result of a key being turned to the locked position, the plough-shaped end portion 26 of the second locking jaw 13 makes contact with the rear edges of the third and fourth locking jaws 21 and 22, said third and fourth locking jaws 21 and 22 being forced outwards, to the locked position illustrated in FIG. 3 in continuous lines. When as a result of a key being turned the first and second locking jaws 12 and 13 are moved to the unlocked position, the third and fourth locking jaws 21 and 22 are likewise moved to the unlocked position by the spring bias.

In the unlocked position the locking device 1 may be moved into or withdrawn from the magazine guide 4. When the locking device 1 is locked inside the magazine guide 4 the fork-shaped end 18 moves into abutment against a recess 27 formed in an annular locking member 28 that is rigidly connected with the barrel 29 of the firearm 3. Further, the third and fourth locking jaws 21 and 22 are pivoted outwards into a recess (not shown) formed in the box of the firearm 3. In this manner the locking device 1 is securely locked to the firearm 3.

The locking device 1 is formed with a lid 30 that covers the eccentric means 8 and the first and second locking jaws 12 and 13. The locking unit 5 has a locking tongue 31 formed in the lid 30, said tongue, when the locking device is positioned in the firearm 3, engaging in a gap 32 formed between the bolt 33 of the firearm 3 and its bolt head 34 when the latter means are in their extended position. In numerous firearms of automatic carbine type, among them AK 4, the bolt head 34 locks the barrel 29, when the bolt 33 is in its extended position. In this situation, not only the bolt 33 but also the barrel 29 are locked by the locking tongue 31 in firearms of this type, a feature which much approves the efficiency of the locking device. in this position, neither the barrel 29 nor the bolt 33 may be removed from the firearm 3 without wanton destruction on the firearm or on the locking device 1. Because the locking tongue 31 locks the firearm bolt 33 re-loading movements to re-load the firearm are not either possible. In accordance with a preferred embodiment, the third and fourth locking jaws 21, 22 engage in the locked position in the associated guide (not shown) in the box of the firearm 3, said guides being provided to guide the movement of the bolt head 34 inside the weapon during use of the latter.

Unauthorized removal of a locking device 1 from the firearm without using the correct key is very difficult. An alternative to removal of the locking device 1 without use of the correct key is to expose the firearm 3 to mechanical damage. Because the locking device 1 in accordance with the embodiment described above is securely locked in position by three locking jaws 12, 21, 22 the firearm 3 need however, be subjected to such extensive destruction to attempt to remove the locking device that after such destruction the firearm 3 may be dangerous to use.

Another alternative is to subject the locking device 1 itself to mechanical wanton destruction. However, in its locking position the locking unit 5 is substantially fully enclosed by the magazine guide 4 the edge of which is illustrated in FIG. 4 by a dashed line, in order to make such destruction and violation difficult. Further, the keyhole 7 is of such a length, preferably at least 10 cm, and/or has such a diameter, preferably no more than 8 mm, that it would be difficult for anyone wanting to drill away the locking device 1 via the keyhole 7 to find commercially available standard drills suiting the purpose. In addition, at least the body 2 of the locking device 1 is manufactured from a hard material, preferably hardened steel, in order to make it even more difficult to damage the locking device 1. It is particularly preferable to manufacture the body 2 from a deep-hardened block of e.g. steel. It is likewise preferable to manufacture for instance the locking jaws from a hard material that has been hardened, and preferably from deep-hardened steel.

Figure 2:
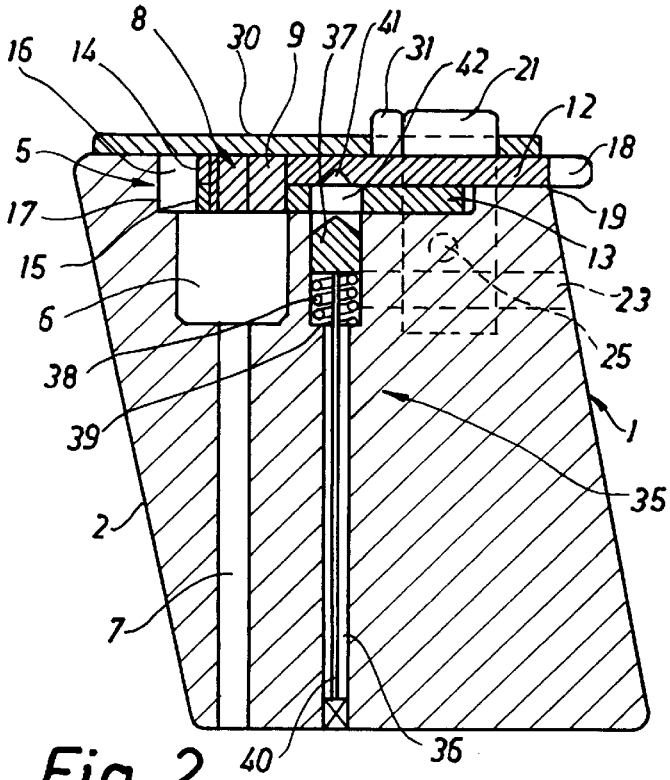
FIG. 2 is a schematical sectional view of the locking device in FIG. 1, the section being taken on line A—A and showing the lid and the locking tongue.
Figure 3:
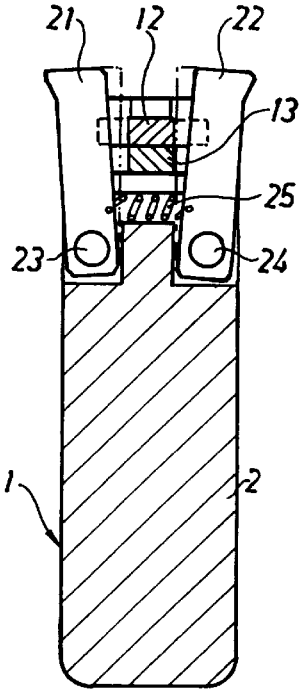
FIG. 3 is a schematical section of the locking device of FIG. 1, the section being taken on line B—B.

In order to make such mechanical damage additionally difficult an engagement catch means, generally designated by numeral 35, is provided in a bore 36 in the locking device 1. The engagement catch means 35 is formed with a spring bolt 37 and with a spring means in the form of a compression spring 38 disposed between a seat 39 and the spring bolt 37. In accordance with the shown embodiment the compression spring 38 is secured to the spring bolt 37 which in the secured position illustrated in FIG. 2 is spring-biased between a safety member 40 extending between the lower part of the spring bolt 37 and the lower part of the locking device 1. The safety member 40 may for instance be a wire. In this secured position illustrated in FIG. 2, the spring bolt 37 is spaced from the first and second locking jaws 12 and 13, these locking jaws 12 and 13, and consequently the third and fourth locking jaws 21 and 22, then being freely movable between the locked and the unlocked positions.

The first and second locking jaws 12 and 13 are formed with apertures 41 an 42, respectively, fitting the upper art of the spring bolt 37. When the first and second locking jaws 12 and 13 are disposed in the unlocked position of FIG. 2, said apertures 41, 42 are located straight above the spring bolt 37. Should the safety member 40 snap as a result of damage to the locking device 1, for instance as a result of attempts to saw it off to reduce the length of the keyhole 5, the spring bolt 37 will be moved by the compression spring 38 to a released position (not shown) in engagement with the apertures 41 and 42, causing all the locking jaws 12, 13, 21, 22 to move to the locked position, which makes unauthorized removal of the locking device 1 from the firearm additionally difficult.

Another alternative of unauthorized removal of the locking device 1 is to pick the locking mechanism 6. Since the keyhole 7 is comparatively long and narrow, this violation method is however made difficult.

Figure 6:
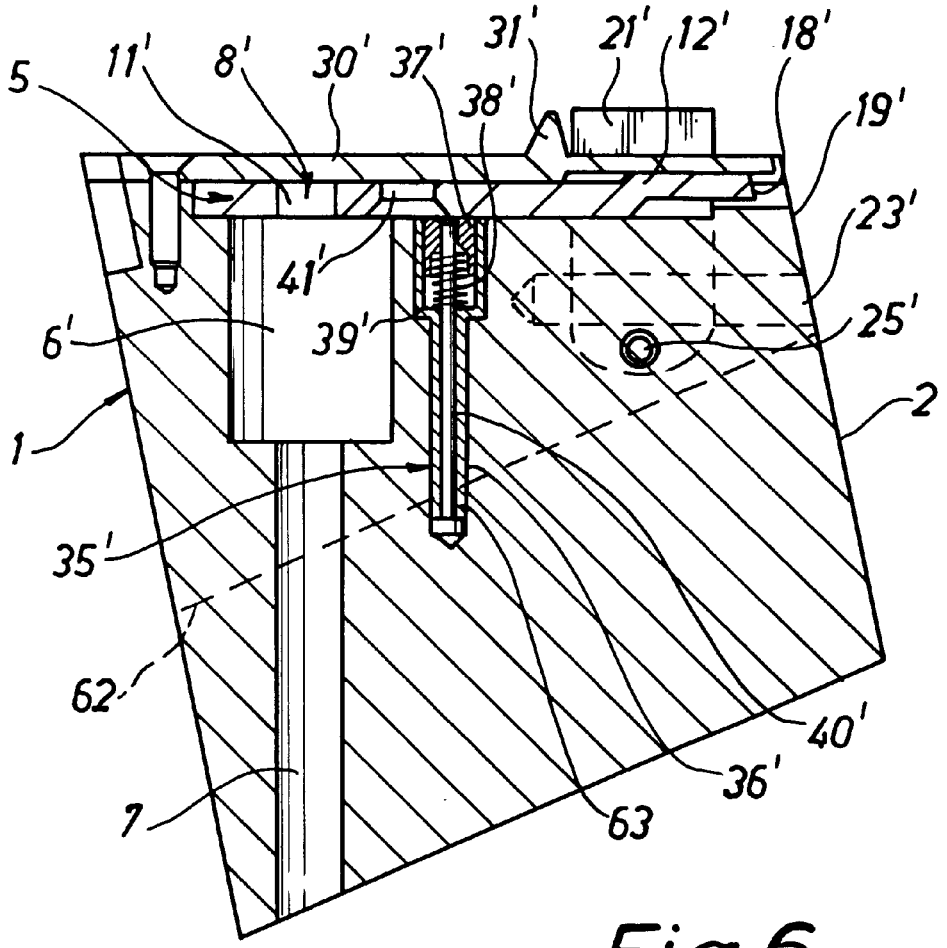
FIG. 6 is a schematical lateral sectional view of a locking device in accordance with another embodiment, the locking device being shown in the unlocked position.
Figure 7:
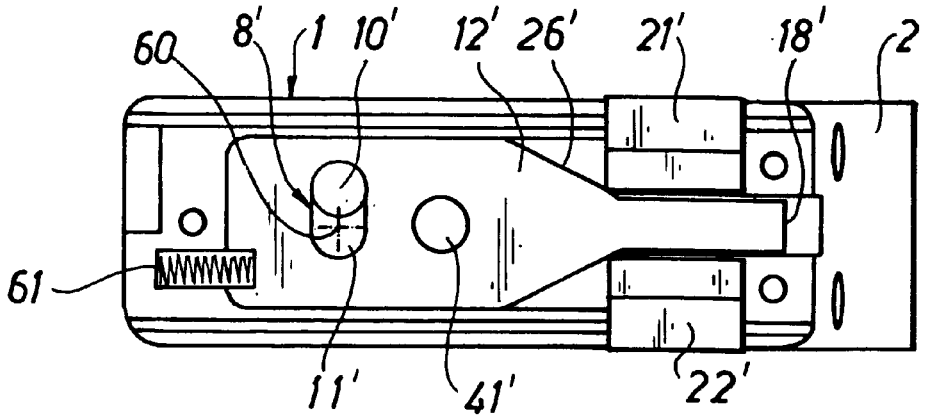
FIG. 7 is a schematical view of the locking device of FIG. 6, being shown in a view from above with the lid having been removed and with the locking tongue in the unlocked position.

FIGS. 6-7 illustrate a second embodiment of the invention in a firearm, such as the one referred to by reference 3 in FIG. 4. Corresponding components to those appearing in the above embodiment have received the same numeral references. In accordance with the second embodiment the locking unit 5 is formed with a locking mechanism 6' which is connected to a spindle 10' forming part of an eccentric means 8'. In turn, the spindle 10' is positively connected with an aperture 11' in a first locking jaw 12'. Like in the first embodiment the locking jaw 12' is movable as a result of actuation of the locking mechanism 6', from the shown, unlocked position to a locked position, not shown, wherein the end 18' of the locking jaw 12' extends beyond the outer edge 19' of the body 2. In accordance with the second embodiment this movement is caused by actuation of the locking mechanism 6' in order to cause the spindle 10' lo rotate over approximately 90° clockwise to effect the displacement to the locked position, respectively to rotate the spindle 10' over approximately 90° counter-clockwise for displacement to the unlocked position about a point 60 shown in FIG. 7.

The embodiment of FIGS. 6-7 likewise is formed with a third locking jaw 21' and a fourth locking jaw 22', like the first embodiment above. The third and fourth locking jaws 21' and 22' are, however, in accordance with this embodiment interconnected by means of a spring in the form of a compression spring 25', which compression spring 25' is disposed underneath the shafts about which the third and fourth locking jaws 21' and 22', respectively, are movable. Like in accordance with the above embodiment, the compression spring 25' is arranged to spring-bias the third and fourth locking jaws 21' and 22' for displacement to the unlocked position. The first locking jaw 12' is formed with a plough-shaped part 26' which, like in the first embodiment above, is arranged to displace the third and fourth locking jaws 21' and 22' to the locked position.

In accordance with the embodiment of FIG. 7 the locking device 1 is formed with a spring member 61 which in accordance with the shown embodiment is a compression spring. The spring member 61 is arranged to bias the locking device 1 to the locked position, it being understood that the spring member 61 may do so against the action of the spring means, i.e. the compression spring 25' designed to actuate the third and fourth locking jaws 21' and 22' for displacement thereof to the unlocked position.

Owing to the spring means, i.e. the compression spring 25', the third and fourth locking jaws 21' and 22' are moved to the unlocked position as the locking device 1 is being unlocked. Owing to the arrangement of the spring member 61 the various locking jaws 12', 21', 22' of the locking device 1 are spring-biased to the locked position in order to establish a "position of rest" of the locking device 1 in the locked position, and to make difficult unauthorized removal of a locked locking device 1 from a firearm.

As appears from FIG. 6 the locking tongue 31' has an outwardly tapering configuration in accordance with this embodiment in order to facilitate insertion thereof in the gap between the bolt of the firearm in question and the bolt head thereof.

In FIG. 6 a dashed line 62 illustrates the lower extention of a magazine guide in the corresponding firearm. From the extension of line 62 appears that the locking unit 5, comprising the locking tongue 31' and the associated locking jaws 12', 21', 22', is disposed in a part of the locking device 1 that is substantially enclosed by the magazine guide as said device assumes the position wherein it is introduced into and is received in said firearm.

The engagement catch means 35' illustrated in FIG. 6 comprises in accordance with this embodiment, a sleeve 63 arranged in a bore 36' formed in the locking device 1. Like in the first embodiment above, the sleeve 63 accommodates a spring bolt 37', a spring means in the shape of a compression spring 38', designed to engage between a seat 39' formed in the sleeve 63 and the spring bolt 37', and a safety member 40'. In the embodiment illustrated in FIG. 6 the safety member 40' extends in a bore formed in the sleeve 63 and is secured to the spring bolt 37' and to the sleeve 63, preferably at its lower end. Should the safety member 40' snap on account of damage to the locking device 1 as the latter assumes its locked position, the spring-biased spring bolt 37' will be moved to a position in engagement with the corresponding aperture 41' in the first locking jaw 12' in a manner similar to that described with respect to the first embodiment. In this situation, the spring bolt 37' engages the locking jaw 12' as well as the body 2 in the locked position. In order to make unauthorized damage to the engagement catch means 35' difficult it is preferable to position the seat 39' and/or the spring means and/or the spring bolt 37' spaced interiorly of the lower edge of the magazine guide (see line 62). To allow for increased spacing between these components and the lower edge of the magazine guide the compression spring 38' extends, in accordance with this embodiment, at least partly through an aperture in the spring bolt 37'. Like in accordance with the above embodiment the bore 36' extends essentially in parallel with the keyhole 7.

It is understood that the body 2, preferably also the first, third and fourth locking jaws 12', 21', 22' are manufactured in accordance with the embodiment of FIGS. 6-7 from a hard material just like in the first embodiment above.

Figure 5:
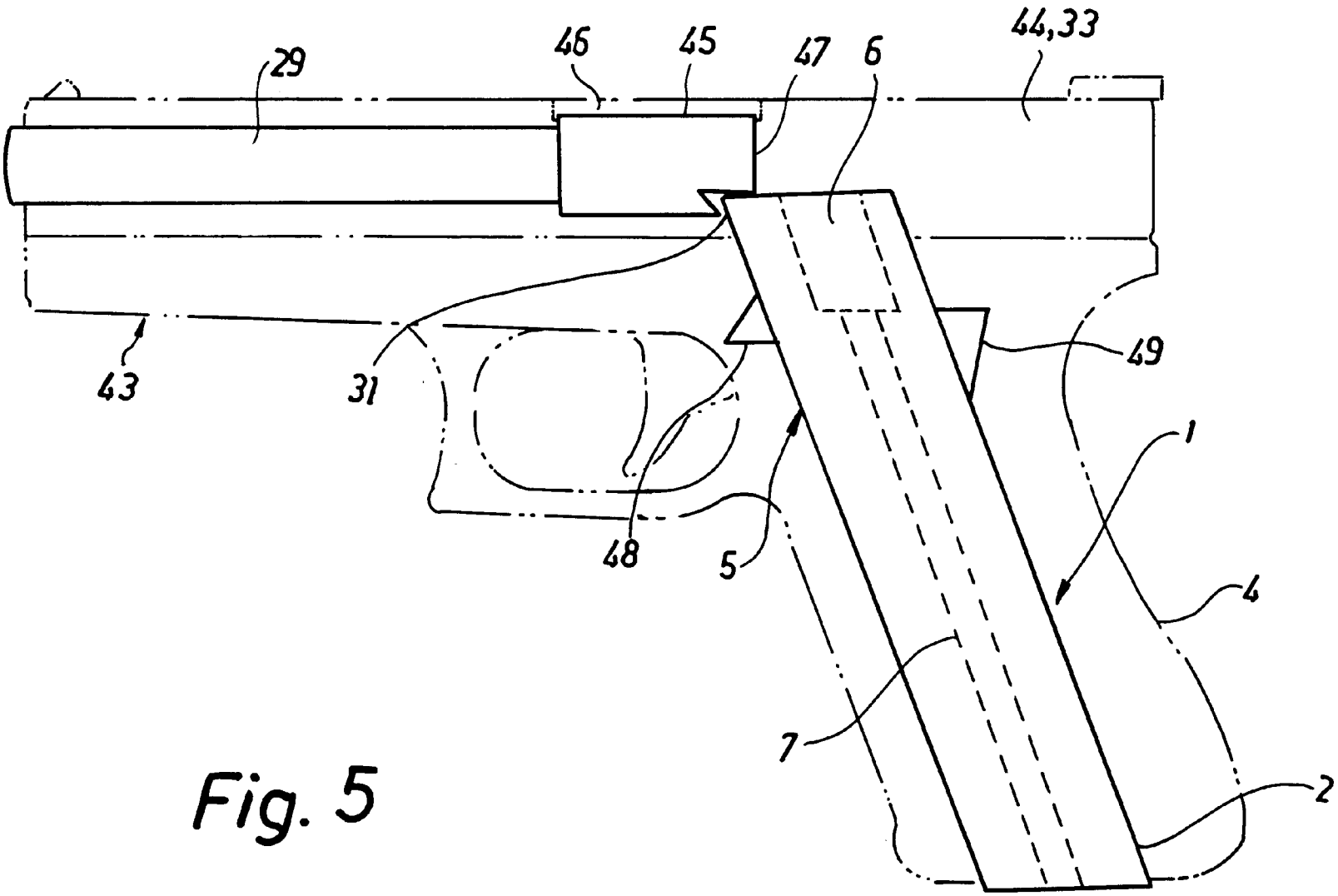
FIG. 5 is a schematical lateral view of a locking device in accordance with an alternative embodiment, the locking device being shown in its locked position in a second firearm.

FIG. 5 illustrates an alternative embodiment of the invention, intended for use with another firearm, in this case a semi-automatic pistol, generally designated by 43. Components corresponding to those of the above embodiment have received identical numeral references.

In this pistol 43, like in most modern pistols, the barrel 29 is locked in the casing 44 upon firing by the engagement of a part of the upper plane 45 of the barrel 29 with an ejector opening 46. During the latter part of the recoil movement, the rear edge 47 of the barrel 29 is then moved downwards while the casing 44 moves to a rear position to allow reload.

The locking device 1 for this pistol 43 in principle functions in the same way as the two embodiments above. First and second locking jaws 48 and 49, disposed in the locked position, lock the locking device 1 in the introduced position as illustrated in FIG. 5. The locking jaws 48 and 49 are displaceable between a locked and an unlocked position via an eccentric means (not shown) and a locking mechanism 6 by means of a key (not shown) in a manner similar to that illustrated with respect to the embodiments above.

A locking tongue 31 is provided in the upper part of the locking device 1, said locking tongue, in the locked inserted position, preventing the rear edge 47 of the barrel 29 from being displaced downwards, a part of the upper plane 45 of the barrel 29 thus remaining in engagement with the ejector opening 46, preventing casing movements, whereby the means that in the pistol 43 corresponds to the bolt is locked indirectly and unauthorized dismantling of the barrel 29 and the bolt cannot be made without damaging the locking device 1 or the pistol 43.

Also this embodiment may be provided with an engagement catch means (not shown). In addition, the body 2 is also in this embodiment manufactured from a hard material, preferably hardened steel, in order to make damage or violation of the locking device 1 more difficult. It is particularly preferable to manufacture the body 2 from a deep-hardened block of e.g. steel.

It is likewise preferable that for instance the various locking jaws are manufactured from a hard material, such as hardened, and particularly deep-hardened, steel. Just like in accordance with the embodiment above, the locking unit 5 is enclosed also in this embodiment by the magazine guide 4, which in this case corresponds to the pistol-grip. In addition, also in this embodiment the body 2 of the locking device 1 has a configuration corresponding essentially to that of the magazine guide 4. In addition, also in this embodiment the keyhole 7 has a preferred length of at least 10 cm and/or a preferred diameter size of a maximum of 8 mm. Obviously, this embodiment too may be formed with transversal locking jaws, should the interior space of the weapon allow such an arrangement.

It is understood that the locking device illustrated in FIG. 5 may be used also in connection with other types of pistols having a barrel the rear part of which is arranged to be displaced downwards during the recoil movement. Consequently, the barrel need not, contrary to the case of the illustrated embodiment, engage an ejector opening upon tiring but could for instance, in a manner known per se, by means of beads formed in the barrel engage guides which are provided in the casing, said engagement locking the rear part of the barrel upon firing, and these beads and guides are adapted to allow the downwardly-directed movement of the rear part of the barrel upon the recoil movement.

The inventive device provides a locking device for firearms which locks the bolt directly or indirectly and which is portable. In addition, the locking device has essentially the same shape as a magazine fitting the firearm, which means that it may be stored in casings or the like intended for standard magazines. A locking device in accordance with the invention is also easy to use, since it may be introduced into a firearm in the same manner as an ordinary magazine. Owing to the structure of the locking device it is also cheap to manufacture.

It is easily understood that certain deviations from the described embodiments are possible. For instance, also the locking unit 5 in accordance with the embodiments of FIGS. 1–4 and FIG. 5 may be spring-biased, whereby all the above-mentioned locking jaws 12, 13, 21, 22 and 48, 48 respectively establish a position of rest in the locked position. The number of locking jaws and the configuration thereof may be varied. For instance, also the first and second locking jaws 12, 13 may be made as one integral piece. The fork-shaped end 18 in accordance with the embodiment of FIGS. 1–4 could have any desired shape fitting a recess formed in the interior of the firearm. This is true also as concerns the various locking jaws 21, 22; 22', 21', 22'; 48, 49. In addition, in the area exteriorly of the magazine guide 4, the locking device 1 may have a color and/or a shape distinguishing it from an ordinary magazine in order to lessen the risk that the locked firearm be used improperly as a scare in robberies and the like without the person or persons being exposed to the threat noticing the locking device 1. The locking tongue 31; 31' can also be movable and displaceable between a locked position and an unlocked position.

The locking device 1 is not limited to the above described firearms but could well be used for all firearms having magazine guides and wherein the locking unit 3 is able to directly or indirectly lock at least the bolt of the firearm.

The various locking jaws 12, 13, 21, 22; 12', 21', 22' and 48 and 49, respectively may be configured differently, depending of the construction of the firearm. The essential feature is that they are able to lock the locking device in position in the firearm.

All varieties and modifications as are comprised by he inventive idea should be regarded to fall within the cope of the appending claims.

I claim:

1. A locking device for firearms, having a magazine guide, said locking device having a body insertable into the empty magazine guide, comprising:

a locking unit for one of a direct and indirect locking of a bolt and casing of the firearm when inserted, said locking unit comprising a locking mechanism having a standard lock cylinder, wherein the locking unit is arranged in an upper part of the locking device, said locking unit enclosed by said magazine guide when the locking device is inserted, wherein a keyhole is provided in the locking device, said keyhole extending between the locking mechanism and a lower part of the locking device.

2. The locking device as claimed in claim 1, wherein the locking unit is arranged to lock the bolt and barrel of the firearm.

3. The locking device as claimed in claim 2, wherein said keyhole has a length which exceeds a length of a standard drill, and a diameter that is relatively smaller than a diameter of a standard drill.

4. The locking device claimed in claim 3, wherein the body of the locking device has a shape corresponding to that of the magazine guide.

5. The locking device as claimed in claim 4, wherein the locking unit includes at least one locking tongue which locks the bolt of the firearm when the locking device is inserted.

6. The locking device as claimed in claim 5, wherein the locking unit is formed with at least one locking jaw which is movable in a longitudinal direction of the firearm and at least one locking jaw which is movable in a transverse direction of said longitudinal direction, each of said at least one jaws movable between a locked position wherein the respective locking jaw projects outwards into a respective aperture in the interior of the firearm and an unlocked position, wherein each respective locking jaw is retracted from said interior aperture.

7. The locking device as claimed in claim 6, wherein the locking unit includes an eccentric means connected to the locking jaw and to the locking mechanism for displacement of said locking jaw.

8. The locking device as claimed in claim 7, wherein the locking device comprises a first and second locking jaw, which said first locking jaw is connected to the eccentric means and is movable in a longitudinal direction respective said firearm, said first jaw movable into and out of engagement with a rear wall of a recess formed in an interior of the firearm, and which comprises a guide means, said second locking jaw transversally movable into and out of engagement with an aperture in the interior of the firearm, which said second locking jaw is spring-biased to a disengagement position, said second locking jaw being movable within said guide means to a locked position together with said first locking jaw.

9. The locking device as claimed in claim 6, further including a bore in the locking device, and an engagement catch means within said bore, said catch means connected to a safety member, said catch means comprising a spring bolt movable between a secured safety position and a released position, which said bolt, in the secured position, is biased so as not to contact with any of said locking jaws and to move to the released position upon destruction of said safety member wherein said catch means lockingly engages at least one of said locking jaws in the locked position.

10. The locking device as claimed in claim 9, wherein the engagement catch means comprises a compression spring held between a seat in the bore and the spring bolt, wherein in the secured position, said spring bolt is spring-biased by the safety member extending between the lower part of the spring bolt and the lower part of the locking device.

* * * * *